US005337243A

United States Patent [19]

Shibata et al.

[11] Patent Number: 5,337,243

[45] Date of Patent: Aug. 9, 1994

[54] VEHICLE ORIENTATION CALCULATING DEVICE

[75] Inventors: Akihito Shibata; Hiroaki Tsuji, both of Yokohama, Japan

[73] Assignee: Matsushita Electric Industrial Co., Ltd., Osaka, Japan

[21] Appl. No.: 790,444

[22] Filed: Nov. 12, 1991

[30] Foreign Application Priority Data

Nov. 13, 1990 [JP] Japan ..... 2-307420

[51] Int. Cl.[5] ..... G06G 7/78

[52] U.S. Cl. ..... 364/449; 364/457; 364/450; 364/454; 342/457; 342/357

[58] Field of Search ..... 364/444, 449, 450, 451, 364/454, 457, 518, 424; 342/357, 451, 461, 457

[56] References Cited

U.S. PATENT DOCUMENTS

| | | | |
|---|---|---|---|
| 4,731,613 | 3/1988 | Endo et al. | 342/357 |
| 4,743,913 | 5/1988 | Takai | 342/457 |
| 4,819,174 | 4/1989 | Furuno et al. | 364/444 |
| 4,837,700 | 6/1989 | Ando et al. | 364/449 |
| 4,924,402 | 5/1990 | Ando et al. | 364/449 |
| 5,058,023 | 10/1991 | Kozikaro | 364/450 |
| 5,087,919 | 2/1992 | Odagawa et al. | 342/357 |
| 5,117,363 | 5/1992 | Akiyama et al. | 364/449 |

FOREIGN PATENT DOCUMENTS

| | | |
|---|---|---|
| 58-70117 | 4/1983 | Japan . |
| 63-177016 | 7/1988 | Japan . |

*Primary Examiner*—Thomas G. Black
*Assistant Examiner*—Jacques Harold Louis-Jacques
*Attorney, Agent, or Firm*—Mason, Fenwick & Lawrence

[57] ABSTRACT

An object of the present invention is to provide precise calculation of a position and an orientation of a vehicle running or moving on route. Regarding the vehicle moving along a given route and with possible variations in the running orientation it is judged that the vehicle has moved substantially on a straight line when an integrated value of the orientation variations is smaller than a predetermined value. By obtaining a regression line of GPS receiving positions in the straight line, a precise orientation of the vehicle is obtained by adding a difference between the orientations of the straight line and the regression line to an original orientation of the vehicle.

10 Claims, 4 Drawing Sheets

VEHICLE ORIENTATION CALCULATING DEVICE

BACKGROUND OF THE INVENTION

The present invention relates to a vehicle orientation calculating device used in a navigation system mounted on a vehicle, in which the position or the orientation of the vehicle, map information of the neighborhood thereof, etc. are displayed.

In a prior art navigation system mounted on a vehicle, as indicated e.g. in JP-A-58-70117, the position and the orientation of the vehicle as well as a trajectory of drive were obtained by means of an angular velocity sensor and a velocity sensor, the trajectory of drive being compared with map data, and the position and the orientation of the vehicle were corrected on a route in the map data so that the trajectory of drive was in accordance with the map data, to be displayed on a display screen.

However the prior art navigation device mounted on a vehicle had a problem that, in the case where there was no chance to correct the position or the orientation over a long distance, e.g. when it was driven on a road, which was not inscribed in a map, errors, were accumulated in the position or the orientation of the vehicle thus calculated so that precise position and orientation of the vehicle were lost.

In order to solve this problem, there was known a method, by which the position of the vehicle was corrected by adding a device for calculating a real position by using external information such as GPS (Global Positioning System), as indicated e.g. in JP-A-63-177016, thereto. However, since GPS had only position information, it has a problem that it was not possible to correct the orientation of the vehicle.

SUMMARY OF THE INVENTION

The object of the invention is to provide an excellent vehicle orientation calculating device capable of correcting precisely not only the position but also the orientation of a vehicle on route.

In order to achieve the above object, according to the present invention, in the case where an integrated value of variations in the orientation obtained by an angular velocity sensor and a velocity sensor over a predetermined distance is below a predetermined value, it is supposed that the vehicle is on route on a straight line; a regression line is obtained from GPS receiving positions in a section, where the vehicle is on route on the straight line; a difference between the orientation of the straight line, on which the vehicle is on route, and the orientation of the regression line is used as an orientation off-set and the orientation of the vehicle is corrected by adding the difference to the original orientation of the vehicle.

Consequently, according to the present invention, an effect can be obtained that, even in the case where there is no chance to correct the position and the orientation over a long distance, it is possible to obtain not only the position but also the orientation of the vehicle by using GPS.

DESCRIPTION OF THE PREFERRED EMBODIMENTS

Figure 1:
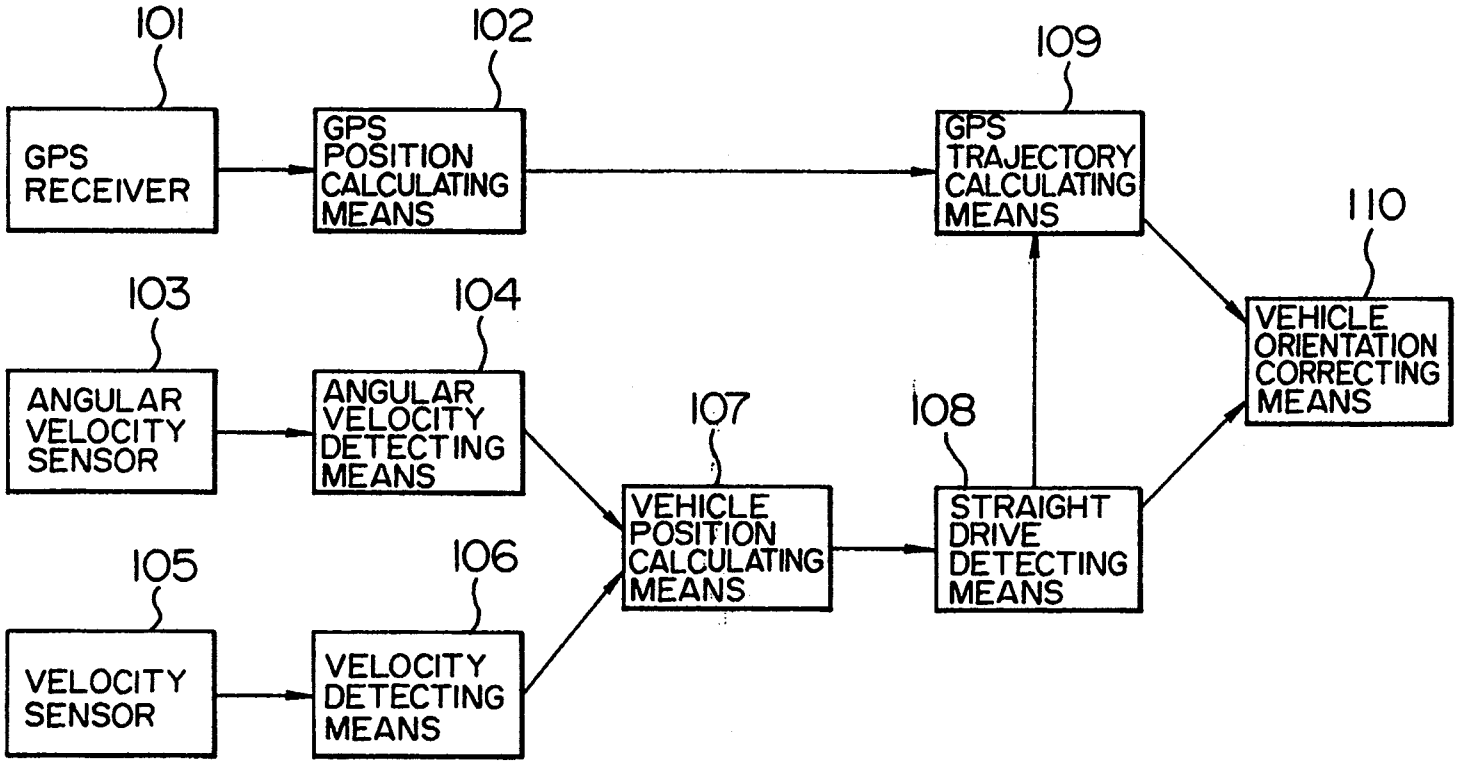
FIG. 1 is a block diagram showing schematically the construction of a vehicle orientation calculating device, which is an embodiment of the invention.

Hereinbelow the present invention will be explained in detail, referring to the drawings. FIG. 1 is a block diagram showing schematically the construction of a vehicle orientation calculating device, which is an embodiment of the invention. In FIG. 1, a GPS receiver 1 receives signals emitted by a plurality of GPS satellites; GPS position calculating means 2 calculates receiving positions on the basis of the signals from the GPS satellites received by the GPS receiver 101; an angular velocity sensor 103 detects the angular velocity of the vehicle; angular velocity detecting means 104 obtains the angular velocity of the vehicle on the basis of output data of the angular velocity sensor 103; a velocity sensor 105 detects the velocity of the vehicle; velocity detecting means 106 obtains a distance, over which the vehicle has moved; on the basis of output data of the velocity sensor 105; 107 is vehicle position calculating means; 108 is straight drive detecting means; 109 is GPS trajectory calculating means; and 110 is vehicle orientation correcting means.

Figure 2:
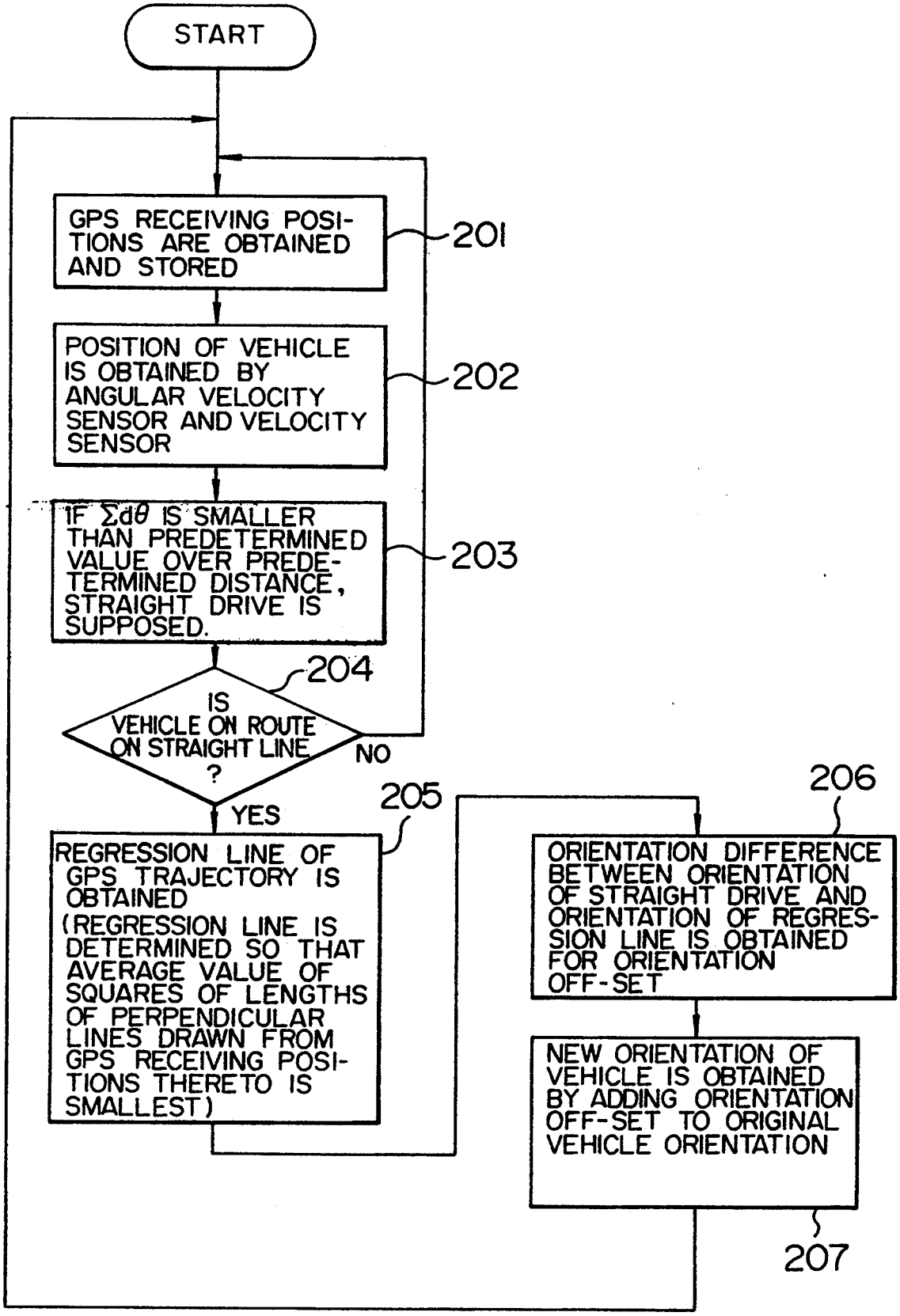
FIG. 2 is a flowchart indicating an orientation calculating operation in the embodiment of the present invention.

Now the operation of the embodiment described above will be explained, referring to the flow chart indicated in FIG. 2. At first, receiving positions (GPS receiving positions), where signals from satellites are received, are calculated by the GPS position calculating means 102 on the basis of data outputted by the GPS receiver 101 and stored in a memory disposed in the GPS position calculating means 102 (Step 201). On the other hand, a rotation angle of the vehicle is obtained by the angular velocity detecting means 104 by using output values of the angular velocity sensor 103 and at the same time a distance, over which the vehicle has moved, is obtained by the velocity detecting means by using output values of the velocity sensor 105. The position and the orientation of the vehicle are calculated by the vehicle position calculating means 107 on the basis of the rotation angle and the distance, over which the vehicle has moved (Step 202).

Denoting an output value of the angular velocity sensor 103 by $d\theta_n$; an output value of the velocity sensor 105 by $dL_n$; positions of the vehicle obtained by the last measurement by $X_{n-1}$ and $Y_{n-1}$; and an orientation of the vehicle obtained by the last measurement by $\theta_{n-1}$, the newest positions $X_n$ and $Y_n$ as well as the newest orientation $\theta_n$ of the vehicle are given by following formulas;

$$\theta_n=\theta_{n-1}+d\theta_n$$

$$X_n=X_{n-1}=dL_n\times\cos(\theta_n)$$

$$Y_n=Y_{n-1}+dL_n\times\sin(\theta_n)$$

Figure 3:
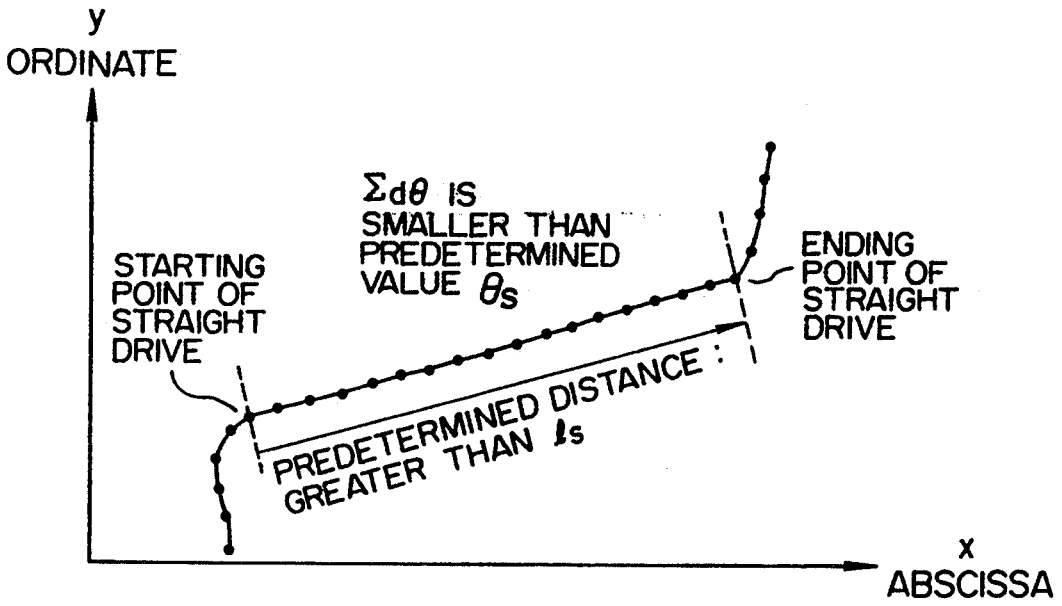
FIG. 3 shows an example of the trajectory, when a drive on a straight line is detected from a trajectory of drive in the embodiment.

Next it is detected by the straight drive detecting means 108 whether the vehicle has moved on a straight line or not. It is judged as indicated in FIG. 3 whether the vehicle has moved on a straight line or not. That is, if an integrated value $\Sigma d\theta$ of variations in the orientation over a predetermined distance $l_s$ is smaller than a predetermined value $\theta_s$ and, in addition, if an orientation variation $d\theta$ for every short section is always smaller than the predetermined value $\theta_s$, it is judged that the vehicle has moved on a straight line (Step 203). This straight drive detection is not necessarily effected for every predetermined distance $l_s$, but for example the straight drive may be judged at a point of time, where the vehicle has moved over more than a predetermined distance and the conditions as described above are fulfilled.

Figure 4:
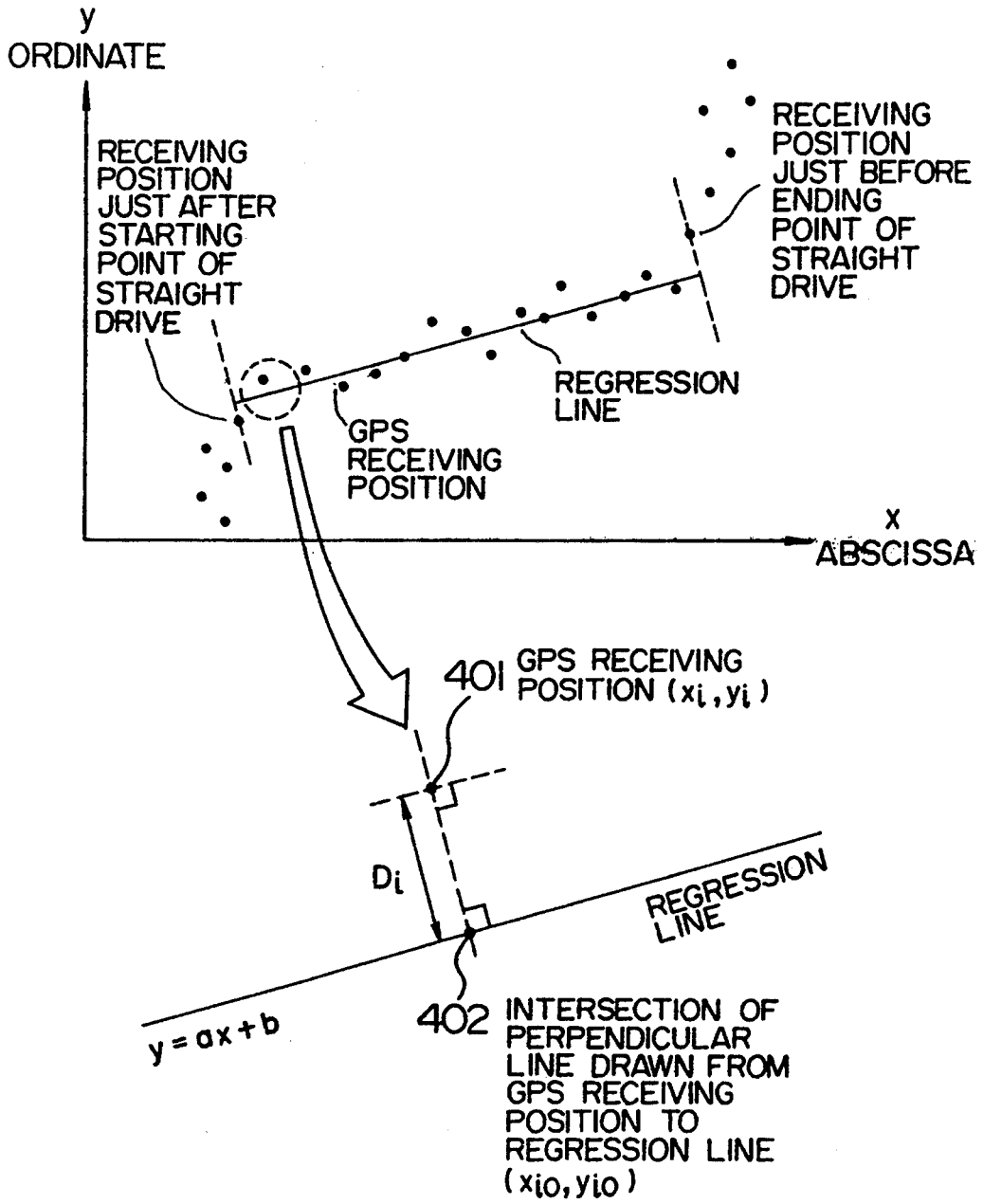
FIG. 4 shows an example, in which a regression line is obtained from GPS receiving positions in the same embodiment.

In the case where it is judged that the vehicle has moved on a straight line (Step 204), a regression line of GPS receiving positions (GPS trajectory) is calculated by GPS trajectory calculating means 109 (Step 205). As indicated in FIG. 4, the regression line is determined so that perpendicular lines are drawn from the GPS receiving positions ($x_i$, $y_i$) 401 thereto to obtain intersections ($x_{i0}$, $y_{i0}$) 402 thereof and the mean value of the squares ($Di^2$) of the lengths of the perpendicular lines is the smallest.

The GPS trajectory is not always limited to a regression line as described above. For example, it may be replaced by a line connecting average positions obtained by calculating averages of receiving positions during periods of time, where the vehicle is stopped for more than a predetermined time at points between a starting point and an ending point of the straight drive detected by the straight drive detecting means 108. The average positions are determined generally so that the average value of the squares of the distances of the GPS receiving positions ($x_i$, $y_i$) therefrom during each of the periods of time, where the vehicle is stopped, is smallest. In this way it is possible to obtain the GPS trajectory more simply than the regression line.

In this way the GPS trajectory is obtained and then a difference in the orientation between the orientation of the regression line and a straight portion (the straight line connecting the starting point and the ending point of the straight drive) in the drive trajectory of the vehicle is obtained as an orientation off-set (Step 206). A new orientation of the vehicle is calculated by adding this orientation off-set to the original orientation of the vehicle (Step 207).

As described above, according to the embodiment described above, even in the case there is no chance to correct the position and the orientation of the vehicle over a long distance, it is possible to obtain not only the position but also the orientation of the vehicle in a simple manner by utilizing GPS.

If an orientation correction is effected, when the GPS receiving positions are disturbed by multipath, etc., the orientation of the vehicle can go worse on the contrary. It is possible to obtain more stably the orientation of the vehicle to prevent such an erroneous procedure as described above by effecting the correction of the orientation, only in the case where the average value of the squares of the distances from real GPS receiving positions to the regression line is smaller than a predetermined value.

I claim:

1. A vehicle orientation calculating device comprising:

a) GPS (Global Positioning System) position calculating means for calculating GPS receiving positions in response to signals received from GPS satellites;

b) vehicle position calculating means for calculating a position of a vehicle, based on;
  1) an angular velocity; and
  2) a velocity of the vehicle;

c) straight drive detecting means, responsive to said vehicle position calculating means, for detecting whether or not the vehicle has moved in a straight line;

d) GPS trajectory calculating means, responsive to said GPS position calculating means, for obtaining a resultant regression line based on GPS receiving positions in a straight drive trajectory of the vehicle, said trajectory calculating means including;
  1) means for defining lines passing through the GPS receiving positions and normal to a tentative regression line;
  2) means for calculating a sum of squares of line lengths from the respective GPS receiving positions to the tentative regression line; and
  3) means for determining the resultant regression line to minimize the calculated sum; and e) vehicle orientation correcting means, responsive to said GPS trajectory calculating means, for adding;
  1) an original orientation of the vehicle; and
  2) an orientation difference between;
    i) the orientation of the vehicle driven in said straight drive trajectory; and
    ii) the resultant regression line determined for said straight drive trajectory.

2. A vehicle orientation calculating device according to claim 1, wherein said straight drive detecting means judges that the vehicle has moved on a straight line, when variations in the orientation of the vehicle in a predetermined drive distance are smaller than a predetermined value.

3. A vehicle orientation calculating device according to claim 2, wherein the angular velocity of the vehicle is detected by using an angular sensor.

4. A vehicle orientation calculating device according to claim 1, wherein said vehicle orientation correcting means corrects the orientation of the vehicle, only in the case where a mean value of distances between said GPS receiving positions and said regression line is smaller than a predetermined value.

5. A vehicle orientation calculating device according to claim 4, wherein the angular velocity of the vehicle is detected by using an angular sensor.

6. A vehicle orientation calculating device according to claim 1, wherein the angular velocity of the vehicle is detected by using an angular sensor.

7. A vehicle orientation calculating device comprising:

a) GPS (Global Positioning System) position calculating means for calculating GPS receiving positions in response to signals received from GPS satellites;

b) vehicle position calculating means for calculating a position of a vehicle, based on;
  1) an angular velocity; and
  2) a velocity of the vehicle;

c) straight drive detecting means, responsive to said vehicle position calculating means, for detecting whether or not the vehicle has moved in a straight line;

d) GPS trajectory calculating means, responsive to said GPS position calculating means, including;
  1) means for calculating a plurality of mean values of GPS receiving positions, where GPS signals have been received in a period in which the vehicle is stopped at positions between a starting position and an ending position of a straight drive trajectory of the vehicle; and 2) means for obtaining a line connecting the starting position and the ending position; and e) vehicle orientation correcting means, responsive to said GPS trajectory calculating means, for adding;

1) an original orientation of the vehicle and 2) an orientation difference between;

i) the orientation of the vehicle in said straight drive trajectory; and ii) the line connecting said starting position and said ending position.

8. A vehicle orientation calculating device according to claim 3, wherein said straight drive detecting means judges that the vehicle has moved on a straight line, when variations in the orientation of the vehicle in a predetermined drive distance are smaller than a predetermined value.

9. A vehicle orientation calculating device according to claim 8, wherein the angular velocity of the vehicle is detected by using an angular sensor.

10. A vehicle orientation calculating device according to claim 7, wherein the angular velocity of the vehicle is detected by using an angular sensor.

* * * * *